United States Patent [19]

Upthegrove

[11] Patent Number: 5,001,822

[45] Date of Patent: Mar. 26, 1991

[54] MULTI-SEGMENT PUNCH ASSEMBLY

[76] Inventor: Robert Upthegrove, P.O. Box 147, Opa Locka, Fla. 33054

[21] Appl. No.: 443,669

[22] Filed: Nov. 30, 1989

[51] Int. Cl.[5] ..... B25B 27/14; B26F 1/00; B26F 1/04

[52] U.S. Cl. ..... 29/275; 30/358; 30/366

[58] Field of Search ..... 30/119, 358, 366; 10/16, 7; 227/151; 72/412, 324; 83/71; 76/107 R; 29/275; 90/275

[56] References Cited

U.S. PATENT DOCUMENTS

| | | | |
|---|---|---|---|
| 1,940,438 | 12/1933 | Stowell | 30/358 |
| 2,850,924 | 9/1958 | Hempel | 76/107 R |
| 3,010,207 | 11/1961 | Barnes | 30/366 |
| 3,650,163 | 3/1972 | Juffs | 76/107 R |
| 4,041,558 | 8/1977 | Victor | 30/358 |
| 4,087,912 | 5/1978 | Granone | 30/366 |
| 4,235,138 | 11/1980 | Creighton et al. | 76/107 R |

*Primary Examiner*—Douglas D. Watts
*Assistant Examiner*—Paul M. Heyrana, Sr.
*Attorney, Agent, or Firm*—Malloy, Downey & Malloy

[57] ABSTRACT

A handheld punch structure having an integrally formed elongated base of one piece construction and formed of a high strength material capable of being struck repeatedly by a striking instrument or used with a hydraulic press structure. The base defines a plurality of integrally formed punch segments thereon wherein successively positioned ones of the punch segments increase in transverse dimension by a predetermined increment successively from one end towards an opposite end and a gripping portion formed thereon to facilitate gripping by the hand of the user.

5 Claims, 1 Drawing Sheet

MULTI-SEGMENT PUNCH ASSEMBLY

BACKGROUND OF INVENTION

1. Field of the Invention

This invention relates to an integral, one piece punch assembly having a plurality of punch segments of varying sizes formed thereon for the added versatility of providing a plurality of punches in a single tool minimizing or eliminating the need to readjust or reposition the tool for operation.

2. Description of the Prior Art

Punch structures of a variety of structural configuration are well known in the art. However, in a typical application, it is prevalent for the user thereof to have a plurality of different sized punches, all being separate instruments, wherein the appropriate sized punch is utilized to perform the required function. More specifically, the punch having the desired size is chosen from a variety of punches as applied to, for example, a bearing assembly for the removal of race structure therefrom by striking one end of the punch with a mallet, hammer or like striking instrument, and thereby separating the components of the bearing assembly.

It is obviously recognized as being inconvenient to maintain a plurality of individual punch instruments which may vary in number up to at least ten separate punches. The punches not only have to be maintained separately but are usually accompanied by some type of carrying case such that the user of the punch assembly can readily refer to the punch of desired size, selected from the plurality of punches available and use it as intended.

In order to avoid the inconvenience of the type set forth above, attempts have been made in the prior art to incorporate a plurality of punches in a s ingle type instrument. This concept is disclosed in the embodied structure of Anderson U.S. Pat. No. 1,114,666. The structure of Anderson discloses an elongated handle having at one end a plurality of punches each mounted on a rotatable base or turntable type member and extending radially outward therefrom in spaced relation to one another. The Anderson structure is primarily used as a punch device for the cutting or punching of leather or like material goods, rather than for the forced assembly or disassembly of a bearing member. Each of the punches obviously differ from one another in size and/or configuration. Operation of this assembly is such as to select the punch of desired size and/or configuration, dispose it in an operative position which is defined by alignment of the punch to be used co-axially with the handle. The aligned and selected punch is "locked" into place and positioned on the instrument, member or material to be punched. A striking instrument, mallet, hammer, etc. is then used to place a striking force on the outer free distal end of the handle so as to operatively actuate the punch in the intended manner. Other distinguishing features of the Anderson structure is that the configuration or taper on the individual punch elements will cause it to "bottom out" and cannot be used effectively to assemble or disassemble bearing structures since the tapered configuration would wedge in the holes of the bearing race. In addition, as set forth above, the punch is clearly not to be intended for use with heavy duty equipment.

While the aforementioned structure is, of course, operable for its intended use, it is questionable from the standpoint of cost, expense, maintenance and general complexity. Therefore, even in light of the existence of this prior art structure, there is a need in the area for a one piece, preferably integrally formed, punch assembly comprising a plurality of punch segments, each of which have an intentionally different size. Such a hand-held punch assembly could be used, for example, to remove or separate the various components of a circular or annular shaped bearing, for example, to remove an inner bearing race from the remainder of the bearing assembly by effectively "punching" such bearing race outwardly.

SUMMARY OF THE INVENTION

The present invention relates to a punch assembly comprising a plurality of punch segments which in effect define individual punch instruments and therefore, take the place of a plurality of separate instruments as is normally found in everyday use.

More specifically, the punch assembly of the present invention comprises an elongated base formed from a high strength metal capable of receiving blows or force from a striking instrument such as a mallet, hammer, or used with a hydraulic press structure, etc. The base is preferably linearly elongated and includes a handle means formed integrally thereon between opposite longitudinal ends of the base. The handle means has a roughened or preferably knurled outer surface to facilitate gripping thereof and also has a longitudinal dimension sufficient to allow sufficient handling or manipulation thereof by the hand of the user. The two oppositely disposed ends of the base are of different sizes. A first opposite end is defined into a first punch segment. The outer extremity thereof has a recessed indentation to facilitate punching and/or cutting.

The remainder of the length of the base from the first segment up to the handle means is formed by a plurality of successively disposed punch segments each having a greater transverse dimension than the last preceding segment. The end of the continuous plurality of punch segments terminates in the handle means as set forth above. The opposite end or second end of the base extends outwardly from the opposite end of the handle means relative to the plurality of continuous punch segments. This second end defines a striking head and more specifically, serves as the striking member or portion to which force is delivered by the striking instrument such as the mallet, hammer, etc.

In operation, the one piece, multi-segmented punch assembly is used in one instance, for the disassembly of the components of an annularly formed bearing assembly. The elongated base is placed through the central opening until the correspondingly sized punch segment engages the inner, annular bearing race. The bearing assembly is properly braced such as in a vice or the like and the outer, now exposed second end is struck by the striking instrument such as the mallet. Force applied to the second end will cause disengagement and separation of the race from the remainder of the assembly as desired. Similarly, it should be equally apparent that a bearing structure could be assembled using the tool of the present invention by positioning the elongated base of the present invention through a central opening of an inner bearing race or the like and forcing the race along with the bearing segments into an operative position such that the bearing members are sandwiched between the inner and outer race members. Accordingly, it should be apparent that the properly sized punch segment will automatically be selected by its failure to pass through the central opening of the bearing race in conventional fashion.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
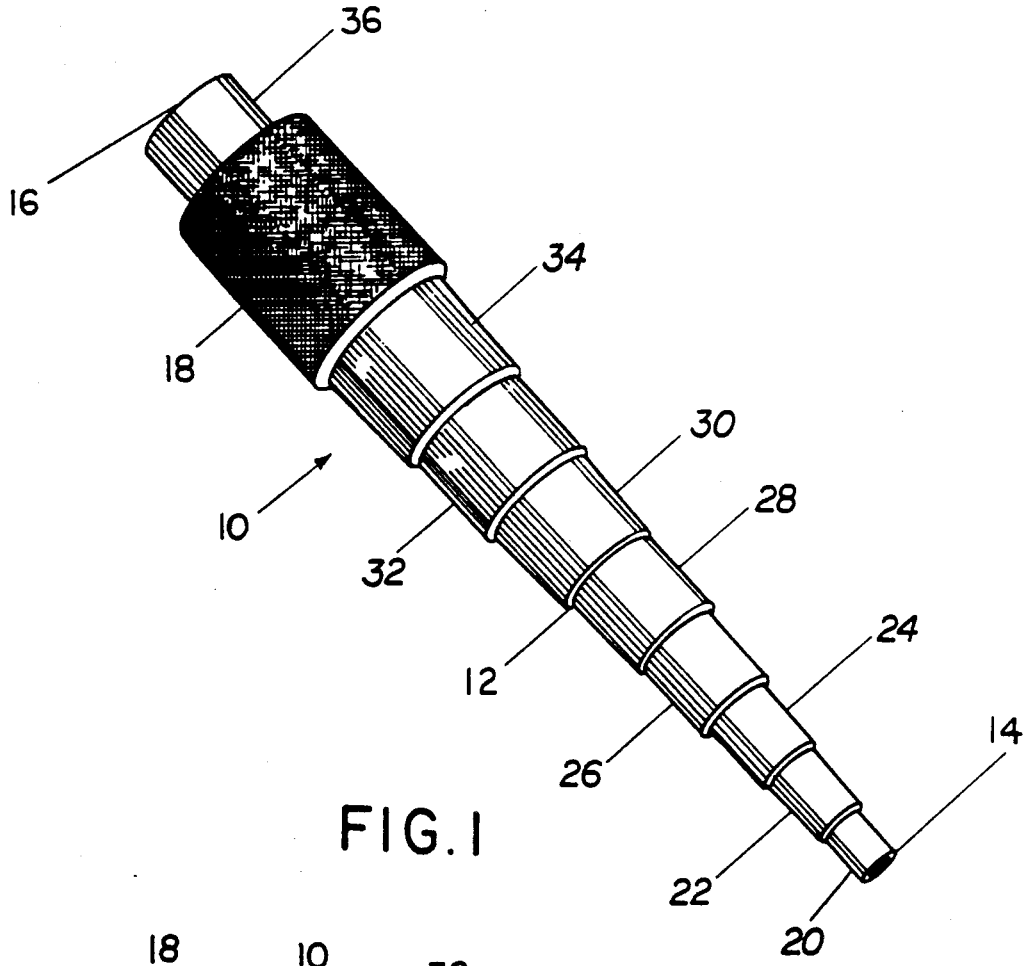
FIG. 1 is a perspective view of the punch assembly of the present invention.

As shown in FIGS. 1 through 4, the present invention relates to a punch structure generally indicated as 10 comprising an elongated base 12 having a first end 14 and a second end 16. The base 12 is preferably formed from an integral, one piece construction and from a high strength material such as metal capable of withstanding repeated blows or striking force from a striking instrument such as a mallet or the like (not shown). The base, as shown throughout the figures, includes preferably a linear configuration.

A handle means 18 in the form of a cylindrical segment 18 is disposed between the ends 14 and 16 and has a roughened or preferably knurled surface to facilitate gripping of the base in an operative position, to be defined in greater detail hereinafter.

An important feature of the present invention is the inclusion of a first punch segment 20 formed at and at least partially defining a first end 14 thereof as shown. A plurality of successively positioned punch segments 22, 24, 26, 28, 30, 32, and 34 extend from the first punch segment 20 to the handle 18. Each of these punch segments are characterized by a successively larger transverse dimension or diameter. While the specific dimensions of such individual punch segments may vary, they are generally increasing in transverse dimension by one-eighth inch. For example, in a preferred embodiment, the first punch segment 20 would have a transverse dimension or diameter of three-eighths inch, the next punch segment 22 would have a transverse dimension of one-half inch. The successively larger punch segments 24 through 34 would increase successively by one-eighth inch as set forth herein. In addition, a preferred length of each of the segments may also vary in that each successive punch segment 20 through 34 may be increased by as much as one-eighth or one-sixteenth of an inch in length.

Figure 2:
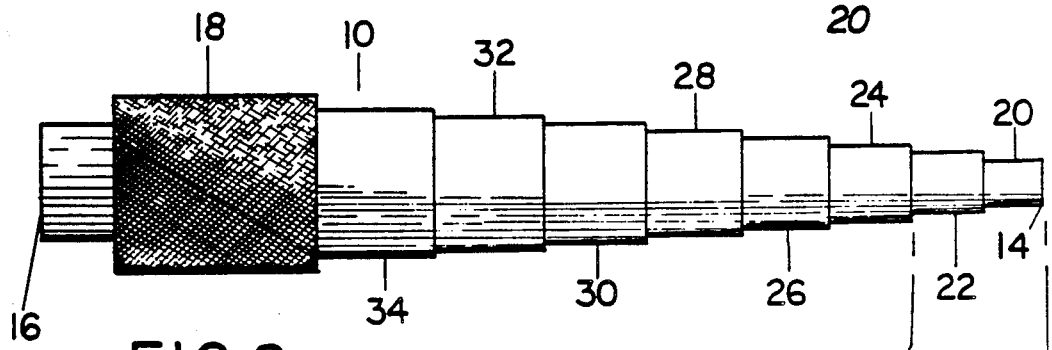
FIG. 2 is a side elevational view of the embodiment of FIG. 1.
Figure 3:
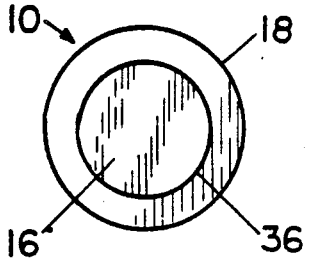
FIG. 3 is an end view along line 3—3 of FIG. 2.
Figure 4:
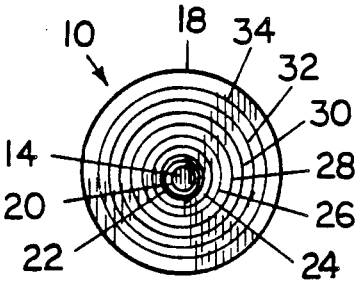
FIG. 4 is an opposite end view along line 4—4 of FIG. 2.
Figure 2A:
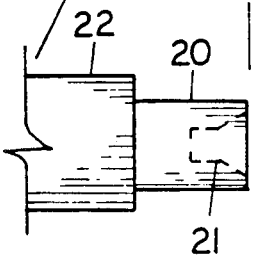
FIG. 2A is a detailed view in partial cut-away and phantom.

The opposite or second end 16 of the base 12 includes what may be considered a striking head 36 but also specifically serves as a striking portion of the base. With reference to FIGS. 2 and 2A, the end most punch 20 includes an indented recess area 21 to serve as a cutting edge which may engage various types of material for cutting or punching.

Now that the invention has been described, what is claimed is:

1. A punch structure designed to be handheld and capable of use as a substitute for a plurality of varied sized individual punches, said punch structure comprising:

a. a base having an elongated configuration terminating at opposite ends and formed of a hard, high-strength material capable of withstanding repeated blows with a striking instrument, b. a plurality of punch segments integrally formed along a portion of the length of said base, each individual punch segment of said plurality of punch segments comprising an outer side wall and a different transverse dimension than the rest of said plurality of punch segments, c. a first of said plurality of punch segments formed on and defining a first of said opposite ends of said base, d. said plurality of punch segments progressively increasing in transverse dimension from said first punch segment to a last of said plurality of punch segments, e. each of said individual punch segments including a substantially flat punch surface formed on one end thereof being substantially perpendicular to said side wall, said punch surface formed and configured to engage in abutting relation with a substantially flat corresponding surface to be punched, f. gripping means integrally formed on said base between said opposite ends and including a roughened outer surface to facilitate holding of said base in an operative position in the hand of the user, and g. a striking head formed on said base and terminating at a second of said opposite ends thereof, such that said gripping means is disposed between and in separating relation to said striking head and a remainder of said plurality of punch segments.

2. A structure as in claim 1 wherein said gripping means is disposed between and in separating relation to said first punch segment and a remainder of said plurality of punch segments and is spaced from an outer extremity of said second end by a length of said striking head.

3. A structure as in claim 2 wherein said striking head comprises a transverse dimension greater than said first punch segment and lesser than said gripping means.

4. A structure as in claim 3 wherein said plurality of punch segments extend continuously from said first punch segment to said gripping means and each of said plurality of punch segments are structured to include a progressively larger transverse dimension than the last preceding punch segment.

5. A structure as in claim 4 wherein each of said plurality of punch segments include an elongated configuration and each increase successively in length from said first punch segment to said gripping means.

* * * * *